US011773549B2

(12) United States Patent
Rico Arenal et al.

(10) Patent No.: US 11,773,549 B2
(45) Date of Patent: Oct. 3, 2023

(54) ROADWAY SAFETY BARRIER

(71) Applicant: INGECID, INVESTIGACIÓN Y DESARROLLO DE PROYECTOS S.L., Boo de Piélagos (ES)

(72) Inventors: Jokin Rico Arenal, Santander (ES); Francisco Ballester Muñoz, Santander (ES); David Helguera López, Santander (ES); Marcos Cerezo Leza, Santander (ES); Fernando Cavada Laza, Santander (ES); Carlos Thomas Garcia, Santander (ES); Juan Antonio Polanco Madrazo, Santander (ES); Jesús Setién Marquínez, Santander (ES)

(73) Assignee: INGECID, INVESTIGACIÓN Y DESARROLLO DE PROYECTOS S.L., Boo de Piélagos (ES)

( * ) Notice: Subject to any disclaimer, the term of this patent is extended or adjusted under 35 U.S.C. 154(b) by 302 days.

(21) Appl. No.: 17/413,585

(22) PCT Filed: Dec. 13, 2019

(86) PCT No.: PCT/ES2019/070844
§ 371 (c)(1),
(2) Date: Jun. 14, 2021

(87) PCT Pub. No.: WO2020/120820
PCT Pub. Date: Jun. 18, 2020

(65) Prior Publication Data

US 2022/0056654 A1 Feb. 24, 2022

(30) Foreign Application Priority Data

Dec. 14, 2018 (ES) ..... ES201831223

(51) Int. Cl.
*E01F 15/08* (2006.01)

(52) U.S. Cl.
CPC ..... *E01F 15/088* (2013.01); *E01F 15/083* (2013.01)

(58) Field of Classification Search
None
See application file for complete search history.

(56) References Cited

U.S. PATENT DOCUMENTS 3,448,963 A * 6/1969 Gravisse ..... E01F 15/083 404/6
4,059,362 A 11/1977 Smith
(Continued)

FOREIGN PATENT DOCUMENTS

EP 0641893 A1 3/1995
EP 1106738 A2 6/2001
(Continued)

*Primary Examiner* — Thomas B Will
*Assistant Examiner* — Katherine J Chu
(74) *Attorney, Agent, or Firm* — SOROKER AGMON NORDMAN RIBA

(57) ABSTRACT

Road safety barrier comprising: concrete bottom parts (1); concrete top parts (2) coupled on the bottom parts (1), and attaching means (3, 31) of the successive top parts (2) at their opposite ends. The bottom parts (1) have an upper surface provided with a longitudinal channel (11) for coupling in the longitudinal direction and with the possibility of limited vertical displacement of a longitudinal extension (21) protruding from a lower surface of the top parts (2); the channel (11) and the extension (21) have similar cross-sections and dimensions calculated so that the top part performs a lateral rotation of a determined amplitude, in the event of a vehicle impact, and absorbs a significant part of its kinetic energy.

5 Claims, 3 Drawing Sheets

(56) References Cited

U.S. PATENT DOCUMENTS

| | | | | | |
|---|---|---|---|---|---|
| 4,089,615 | A * | 5/1978 | Almer | E01F 15/088 | 404/6 |
| 4,190,380 | A * | 2/1980 | Almer | E01F 9/669 | 404/6 |
| 6,679,649 | B1 * | 1/2004 | Capolupo | E01F 15/0476 | 404/6 |
| 6,767,158 | B1 * | 7/2004 | Consolazio | E01F 15/088 | 404/6 |
| 7,654,768 | B1 * | 2/2010 | Tullis | E01F 15/083 | 404/6 |
| 9,644,332 | B1 | 5/2017 | Smith | | |
| 2003/0068199 | A1 * | 4/2003 | Ulislam | E01F 15/083 | 404/6 |
| 2003/0161683 | A1 * | 8/2003 | Lembo | E01F 15/083 | 404/6 |
| 2005/0254892 | A1 * | 11/2005 | Yodock | E01F 15/083 | 404/6 |
| 2019/0368143 | A1 * | 12/2019 | Kim | E01F 15/085 | |
| 2020/0109531 | A1 * | 4/2020 | Powell | E01F 13/02 | |

FOREIGN PATENT DOCUMENTS

| | | | | |
|---|---|---|---|---|
| EP | 2511422 | A1 | 10/2012 | |
| JP | H07 42124 | A | 2/1995 | |
| KR | 2011 0131633 | A | 12/2011 | |
| WO | WO-2007009134 | A1 * | 1/2007 | E01F 15/083 |

* cited by examiner

ROADWAY SAFETY BARRIER

TECHNICAL FIELD

The present invention relates to a road safety barrier comprising a series of prefabricated concrete parts with constant cross-section, facing each other at their longitudinal ends and which include: bottom parts making up the base of the barrier, and top parts making up the body of the barrier, said top parts being attached by attaching means which connect the facing ends thereof.

This road safety barrier is within the field engaged in the manufacture of protective elements intended to delimit vehicle traffic areas.

BACKGROUND ART

Currently, barriers used to delimit vehicle traffic areas constituted of concrete parts with constant cross-section along their length and which are attached to the ground or which simply are supported thereon, are widely known.

Among concrete barriers, barriers are known formed by a series of concrete elements having a single part body, and barriers formed by bottom parts making up a base of the barrier and top parts which are supported on the bottom parts and conforming the body of the barrier itself, the latter, made by a top part and another bottom part, being those which are the closest to the road safety barrier object of this invention.

In barriers made up of a top part and another bottom part, the bottom parts with constant cross-section along all their length are arranged in alignment and comprise, on their upper surface, a longitudinal extension protruding towards the upper area, while the top parts have, on their bottom surface, a longitudinal groove for receiving the longitudinal extension of the bottom parts, enabling said top parts to be vertically assembled and dissembled. A barrier of this type can be seen, for example in the U.S. Pat. No. 4,059,362. The disadvantage of this barrier, likewise with the barriers made up of a single part of concrete, is that they do not have a structure suitable to be deformed and to significantly absorb the kinetic energy of a vehicle in the event of an impact and, therefore, they do not minimise the harmful effects to those involved in the accident.

Road safety barriers also usually have attaching means for attaching the successive parts at their facing longitudinal ends, helping to maintain the alignment of the successive parts.

For example, rigid reinforcements housed in housings provided in the concrete elements of the barrier are used in patent EP 1106738 A2 to ensure the continuity of the road safety barrier parts.

In the patent EP 0641893 A1, metal H-shaped parts are used as fastening elements whose opposite ends are inserted vertically in C-shaped housings defined on the opposite ends of the concrete parts.

These attaching elements, like others on the market, have the disadvantage that, in the event of the barrier receiving a very strong impact, the constituent parts of the barrier are excessively misaligned, and the top parts then could be released from the bottom parts of the barrier and said top parts could be broken at the assembly areas of the attaching means.

Road protection barriers generally have, at the bottom or base, a protruding part whose purpose is to return the vehicle to the road in the event that the wheels of the vehicle impact the barrier at a reduced speed; however, when the vehicle impacts at a higher speed, the wheels exceed this edge or projection of the barrier, the vehicle impacting against the vertical body or element of the barrier.

One problem with existing barriers is that, in the event of an impact, it is the vehicle that absorbs the energy, with the consequent high risk of injury to occupants.

An alternative are safety barriers that are not fixed to the ground and that can be displaced, absorbing the displacement of the barrier by the impact, part of the kinetic energy of the vehicle, reducing the risk of damage to the occupants of the vehicle. However, the problem with the use of these displaceable barriers is that they cannot be installed in certain areas, for example on the central reservation of traffic routes since, in the event of an impact, such a barrier would invade the opposite lane; and if these barriers were to be installed on the sides of the traffic routes, a space would have to be provided on each side for the displacement of the barrier in the event of an impact.

Therefore, in view of the background existing in the state of the art and the existing problems with road safety barriers, the technical problem that arises is the development of a barrier with bottom parts that act as a base and that are not displaced in the event of an impact, and that has top parts connected to each other and to the base, so that they can absorb a significant part of the kinetic energy of a vehicle in the event of an impact, reducing the severity of the impact, with the consequent reduction of possible harmful effects to those involved in the accident and, consequently, improving the level of containment.

SUMMARY OF HE INVENTION

The road safety barrier object of this invention, which comprises prefabricated concrete parts including: bottom parts forming the base of the barrier, top parts forming a vertical body or element of the barrier and, optionally, means for attaching successive top parts, has characteristics aimed at significantly increasing the absorption of kinetic energy during the impact of a vehicle through deformation of the structural system of the barrier.

Thus, one objective of the road safety barrier, object of the invention, is to reduce impact severity (ASI index) and improve containment level.

The geometric and mechanical characteristics of the assembly make its behaviour on impact less damaging to those involved in the accident, compared to existing concrete barriers in the state of the art.

According to the invention, the bottom parts of the barrier have an upper surface provided with a longitudinal channel for coupling, in a longitudinal direction and with the possibility of limited vertical displacement, a longitudinal extension protruding from a bottom surface of the top parts; said longitudinal channel of the bottom part and said longitudinal extension of the top part having similar cross-sections and with dimensional differences calculated so that, in the event of an impact of a vehicle, the top part maintains its integrity and performs, with respect to the vertical median plane of the bottom part, a lateral rotation of an amplitude determined and limited by the coupling means of the upper and bottom parts.

In the case that the barrier incorporates attaching means for the top parts, said attaching means cooperate with the coupling means in limiting the lateral rotation of the top part with respect to the bottom part.

The possibility of limited vertical displacement of the top part with respect to the bottom part, together with the also limited lateral rotation of said top part with respect to the bottom part, contributes to improving the absorption of kinetic energy from the impact.

According to the invention, the longitudinal channel of the bottom part and the longitudinal extension of the top part comprise, at least: an upper segment of decreasing overall width towards the bottom area, and a bottom segment of a width comprised between the greater and lesser widths of said upper segment.

This characteristic and the dimensional difference between the longitudinal channel of the bottom part and the longitudinal extension of the top part allow, in the event of an impact, the lateral rotation, of limited amplitude, of the top part with respect to the bottom part and prevent said top part from being released in the vertical direction from the bottom part of the barrier.

Preferably, the attaching means of the successive top parts comprise threaded rods, of the dywidag type, assembled longitudinally through the top parts of the barrier and attached with the successive threaded rods by threaded sleeves; or metal parts embedded at the opposite ends in holes or housings defined for this purpose at the opposite ends of the said top parts of the barrier. In the event of an impact, said attaching means contribute to limiting the lateral rotation of the top parts relative to the bottom parts of the barrier, minimising the risk of breakage or detachment of concrete fragments from the parts of the barrier.

In order to avoid these breakages or partial detachments of concrete, it has been provided that both the longitudinal channel of the bottom part and the longitudinal extension of the top part have longitudinal rounded edges, also promoting the lateral rotation of the top part in the event of an impact.

Preferably, the bottom parts of the barrier are anchored to the ground with no possibility of lateral displacement, thereby preventing the parts of the barrier from invading the traffic lanes in the event of an impact.

In this invention it has also been provided that the bottom parts and the top parts have the same length and that they can be aligned vertically in pairs, i.e., overlapping; or displaced mutually in a longitudinal direction, in a staggered way, so that the joints of the bottom parts are displaced in a longitudinal direction with respect to the joints of the top parts.

The characteristics of the invention will be more readily understood in view of the example embodiment shown in the accompanying drawings described below.

BRIEF DESCRIPTION OF THE CONTENTS OF HE DRAWINGS

In order to complement the description that is being carried out and with the purpose of facilitating the understanding of the characteristics of the invention, the present description is accompanied by a set of drawings wherein, by way of a non-limiting example, the following has been represented:

DETAILED EXPLANATION OF EMBODIMENTS OF THE INVENTION

Figure 1:
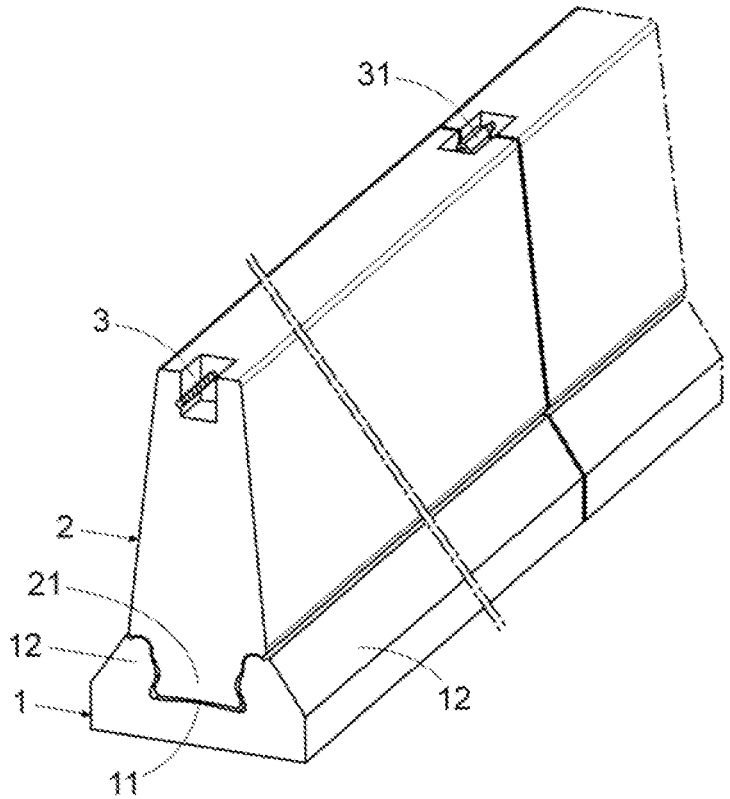
FIG. 1 shows a perspective view of one exemplary embodiment of the road safety barrier, according to the invention.

As can be seen in FIG. 1, the road safety barrier of the invention comprises bottom parts (1) and top parts (2) of concrete, prefabricated and of constant cross-section in the longitudinal direction.

Figure 2:
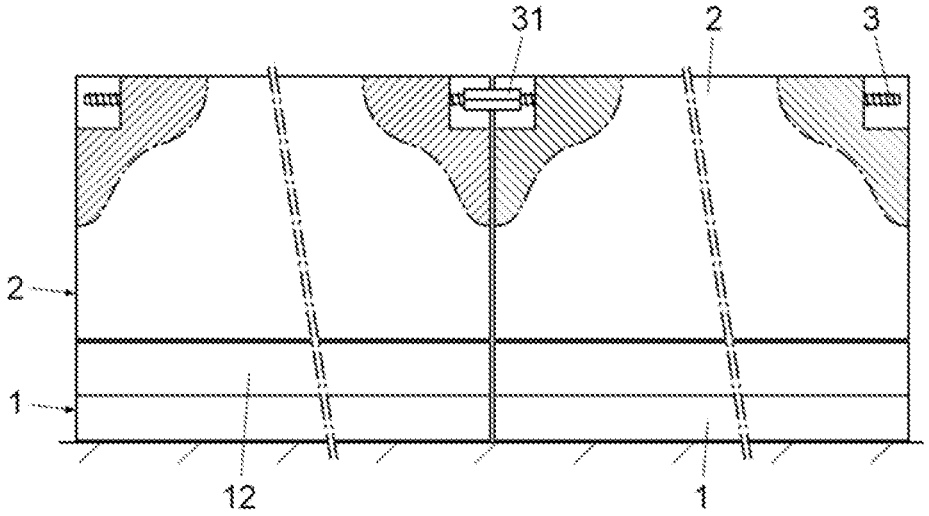
FIG. 2 shows an elevational view of a barrier segment in which the top parts have been partially sectioned to allow visualisation of the attaching means thereof which, in this exemplary embodiment, comprise threaded rods attached at their ends by threaded sleeves.

As can be seen in FIGS. 1 and 2, both the bottom parts (1) and the top parts (2) are facing each other at their longitudinal ends forming respective alignments.

The successive top parts (2) are connected by attaching means, consisting of threaded rods (3), of the dywidag type, which pass through the interior of said top parts (2) and which are fixed at their ends by threaded sleeves (31). These attaching means cooperate with the coupling of the extension (21) and the channel (11) in limiting the lateral rotation of the top parts (2) in the event of an impact of a vehicle against the barrier.

Each of the bottom parts (1) has, on its upper surface, a longitudinal channel (11) for coupling in the longitudinal direction, like a slide, a longitudinal extension (21) protruding from the lower surface of the top parts (2).

The channel (11) and the extension (21) have similar cross-sections with dimensional differences that facilitate their coupling in the longitudinal direction and limit their relative displacement in the vertical direction.

Figure 3:
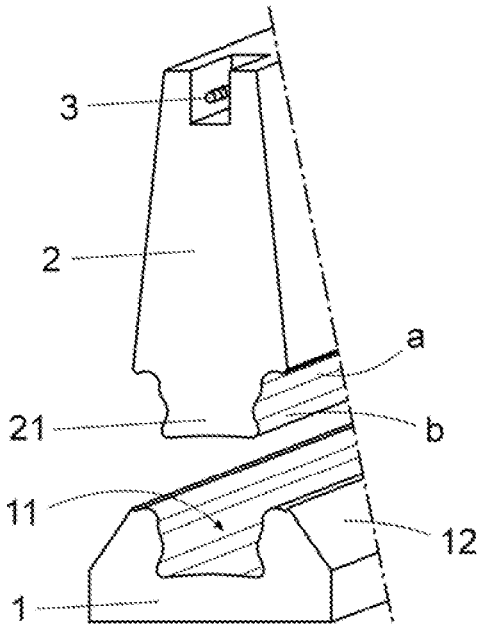
FIG. 3 shows an exploded, profile view of a bottom part and a top part of the barrier.

In FIG. 3 it can be seen that both the channel (11) of the bottom part and the extension (21) of the top part have an upper segment, referred to as (a) in the extension (21), of decreasing overall width towards the lower area; and a lower segment (b) of a width between the greater and lesser width of the upper segment (a).

Figure 4:
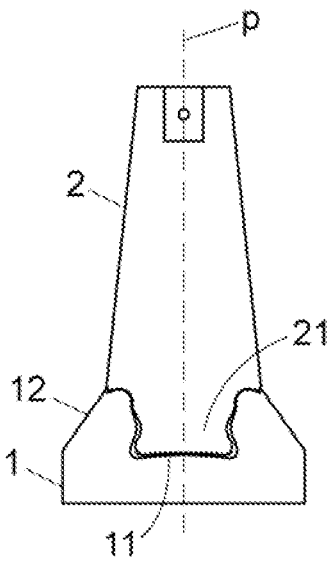
FIG. 4 shows a profile view of the barrier shown in FIGS. 1 and 2, and in which a top part coupled to a bottom part of the barrier can be seen.

Once the extension (21) is coupled longitudinally in the channel (11), the top part (2) is arranged vertically in alignment with the longitudinal median plane (p) of the bottom part (3), as shown in FIG. 4.

Figure 5:
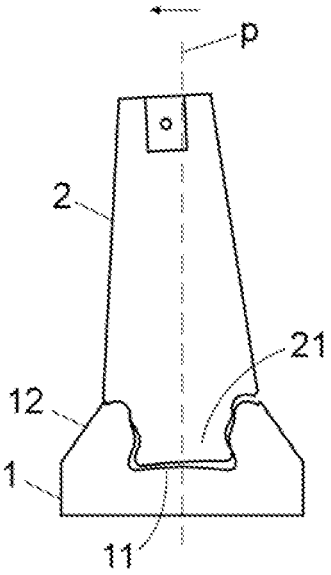
FIGS. 5 and 6 show two profile views in which the limited rotation of the top parts towards one or the other side with respect to the vertical median plane of the bottom parts in the event of an impact can be seen.
Figure 6:
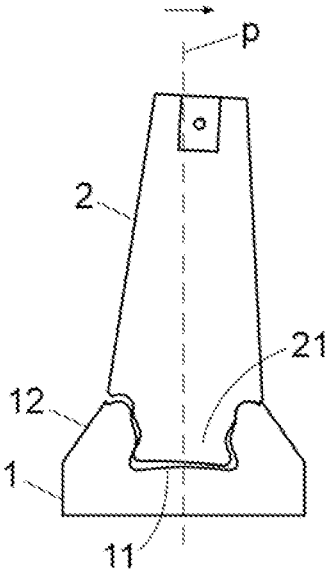

Due to the shape and dimensional difference between the channel 11) of the bottom parts (1) and the longitudinal extension (21) of the top parts (2), when the barrier receives a lateral impact from a vehicle, the top part (2) makes a rotation to either side with respect to the vertical median plane (p) of the lower part (1), as shown in FIGS. 5 and 6, which contributes to improving the absorption of kinetic energy from the impact and reducing the harmful effects to those involved in the accident.

Figure 7:
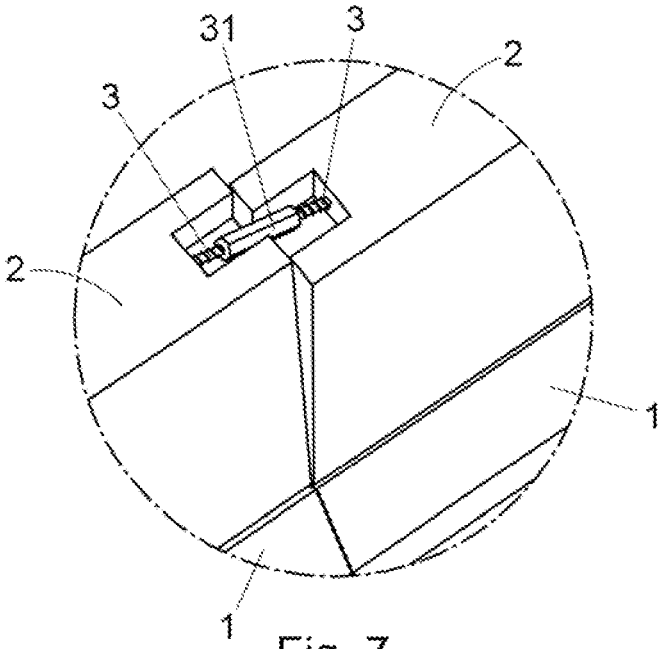
FIG. 7 shows a lateral-top perspective detail of the ends of two consecutive top parts, and in which the fastening thereof by the attaching means can be seen when one of them rotates laterally, as shown in FIGS. 5 and 6, due to a lateral impact.

The lateral rotation of the top parts (2) with respect to the bottom parts (1) is limited by the geometry of the channel (11) of the bottom parts and by the longitudinal extension (21) of the top parts, the possibility of rotation being also limited by the action of the attaching means, in this case the threaded rod (3), as shown in FIG. 7.

Calculations and tests carried out during the development of this road safety barrier of the present invention have shown that, with the characteristics indicated, this barrier absorbs up to 25% of the total kinetic energy of the impact of a vehicle, which far exceeds the energy absorption capacity of the concrete barriers existing on the market.

In the embodiment shown, and as can be seen for example in FIG. 1, the bottom parts present the typical cross-section in a generally trapezoidal shape, with side ramps (12) tending to return the vehicle to the road in the event of a low speed impact.

Figure 8:
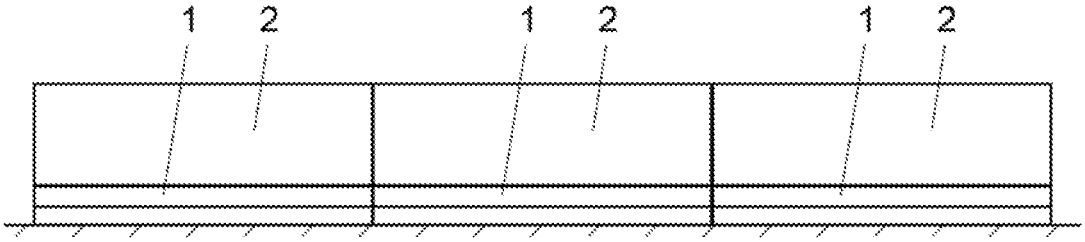
FIGS. 8 and 9 show elevational views of a barrier according to the invention, wherein the top parts are respectively aligned and misaligned in a longitudinal direction with respect to the bottom parts of the barrier.
Figure 9:
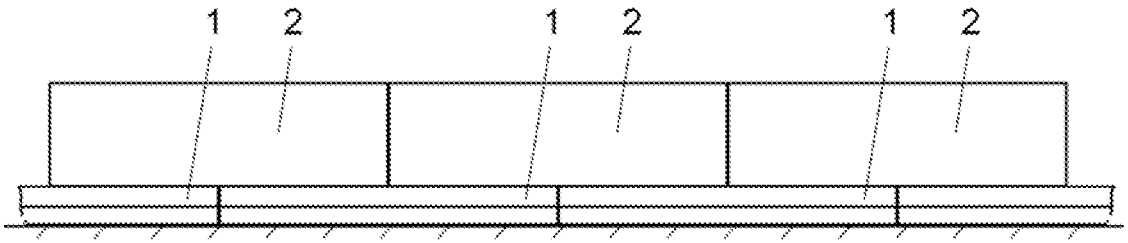

Finally, and as shown in FIGS. 8 and 9, it has been provided that the bottom parts (1) and the top parts (2) have the same length, in this exemplary embodiment of about 6 metres, and that, in the assembling position, the top parts (2) and the bottom parts (1) can be aligned vertically in pairs, i.e., with their longitudinal ends vertically aligned, as shown in FIG. 8; or displaced in the longitudinal direction, in a staggered way, as shown in FIG. 9.

The invention claimed is:

1. A road safety barrier comprising a series of prefabricated concrete parts, of constant cross-section, facing each other at their longitudinal ends, which include: bottom parts (1), forming a barrier base, and top parts (2), forming a barrier body, supported and coupled on the bottom parts (1); characterised in that the bottom parts (1) have an upper surface provided with a longitudinal channel (11) for coupling in the longitudinal direction and with the possibility of limited vertical displacement of a longitudinal extension (21) protruding from a lower surface of the top parts (2); said longitudinal channel (11) of the bottom part (1) and said longitudinal extension (21) of the top part (2) having similar cross-sections, and with calculated dimensional differences so that, in the event of an impact of a vehicle, the top part maintains its integrity and performs, with respect to the vertical median plane (p) of the bottom part (1), a lateral rotation of an amplitude determined and limited by the coupling means of the top and bottom parts, the coupling means comprising the longitudinal channel (11) of the bottom part (1) and the longitudinal extension (21) of the top part (2); the longitudinal channel (11) and the longitudinal extension (21) each comprise at least: an upper segment (a) of decreasing overall width towards a lower area, and a lower segment (b) of a width between the greater width and the lesser width of the upper segment (a).

2. The barrier, according to claim 1, characterised in that the successive top parts (2) are connected by attaching means (3, 31) that cooperate with the coupling of the extension (21) and the channel (11) in limiting the lateral rotation of the top parts (2), in the event of an impact of a vehicle against the barrier.

3. The barrier, according to claim 1, characterised in that the longitudinal channel (11) of the bottom part (1) and the longitudinal extension (21) of the top part (2) have rounded longitudinal edges.

4. The barrier, according to claim 1, characterised in that the bottom parts (1) are anchored to the ground, with no possibility of displacement.

5. The barrier, according to, claim 1, characterised in that the bottom parts (1) and the top parts (2) have the same length and are vertically aligned in pairs; or mutually displaced in a longitudinal direction, in a staggered way.

* * * * *